US007601081B1

(12) United States Patent
Larkey

(10) Patent No.: US 7,601,081 B1
(45) Date of Patent: Oct. 13, 2009

(54) APPARATUS FOR TEACHING IMPROVED PITCHING MECHANICS OF A PITCHER

(76) Inventor: Roger Elwin Larkey, 10300 Cypresswood Rd., Apt. #1511, Houston, TX (US) 77070

( * ) Notice: Subject to any disclaimer, the term of this patent is extended or adjusted under 35 U.S.C. 154(b) by 87 days.

(21) Appl. No.: 11/741,569

(22) Filed: Apr. 27, 2007

(51) Int. Cl.
*A63B 69/40* (2006.01)
*A63B 63/00* (2006.01)
*A63B 69/00* (2006.01)

(52) U.S. Cl. ..... 473/454; 473/422

(58) Field of Classification Search ..... 473/422, 473/451, 452, 454–456
See application file for complete search history.

(56) References Cited

U.S. PATENT DOCUMENTS 1,879,316 A * 9/1932 Kleb ..... 473/454
4,473,227 A * 9/1984 Klaus ..... 473/454
4,783,070 A * 11/1988 Bauer et al. ..... 473/453
5,000,449 A * 3/1991 Weeks ..... 473/452
5,348,291 A * 9/1994 Scully ..... 473/454
5,511,775 A * 4/1996 Parks ..... 473/454
5,516,115 A * 5/1996 McLain ..... 473/417
5,553,847 A * 9/1996 Surrency ..... 473/453
5,704,855 A 1/1998 Kellogg, Jr.
5,746,671 A * 5/1998 Ritchie ..... 473/454
5,803,841 A * 9/1998 Daskoski ..... 473/454
6,139,450 A * 10/2000 Rivers ..... 473/422
6,663,512 B2 * 12/2003 Martin ..... 473/452
6,663,513 B2 * 12/2003 Howard ..... 473/454
6,896,630 B1 * 5/2005 Breining ..... 473/422
6,899,646 B2 * 5/2005 Conradi ..... 473/454
6,945,883 B1 * 9/2005 Williams et al. ..... 473/452
7,338,395 B1 * 3/2008 Hurley ..... 473/454
2004/0033849 A1 2/2004 Socci
2004/0077436 A1 4/2004 Goucher et al.
2004/0132557 A1 7/2004 Broglio et al.
2006/0142099 A1 * 6/2006 Trucks ..... 473/452

* cited by examiner

*Primary Examiner*—Mitra Aryanpour
(74) *Attorney, Agent, or Firm*—Egbert Law Offices PLLC

(57) ABSTRACT

A apparatus for improving pitching mechanics of a pitcher has a base, a member extending vertically upwardly from the base, a boom extending horizontally outwardly from the member, and a first indicator affixed to the boom for corresponding in relative location to a position where the pitcher's lead foot or lead shoulder should be positioned. A second indicator is connected to the boom for corresponding in relative location to the desired release point of a pitch by the pitcher. The member is adjustably positioned in height relative to the base.

7 Claims, 4 Drawing Sheets

APPARATUS FOR TEACHING IMPROVED PITCHING MECHANICS OF A PITCHER

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to apparatus and devices that are used for teaching and coaching the proper pitching mechanics to a pitcher. Additionally, the present invention relates to apparatus wherein the pitching mechanics are improved by providing a visual indication to the pitcher of the desired release point and the desired location of the lead shoulder and lead foot of the pitcher.

2. Description of Related Art Including Information Disclosed Under 37 CFR 1.97 and 37 CFR 1.98

During pitching activities, it is important that a pitcher maintain proper fundamentals so that the pitcher achieves the desired velocity and location of the pitch. In many circumstances, the mechanics of the pitcher will vary greatly during the course of a baseball or softball game. In certain circumstances, the changed mechanics of the pitcher will cause the pitches to stray from the desired strike zone. In other circumstances, the pitcher will lose velocity by adopting incorrect or improper mechanics. Since control and velocity of a pitch is particularly desirable to the pitcher, it is important to be able to maintain the proper mechanics so as to achieve the desired results.

In the past, the maintenance of proper mechanics of a pitcher was solely the province of the pitcher or the pitching coach. The pitching coach was required to visually see the desired mechanics of the pitcher and verbally inform the pitcher of any changes in mechanics. A great deal of error can occur from the visual observation of such pitching mechanics. In circumstances where the pitcher alone tries to determine proper mechanics, fatigue will often cause the pitcher to ignore such mechanics during the course of the game.

Ultimately, muscle memory is enhanced by assuring that the proper pitching mechanics occur on every pitch. As muscle memory develops, the pitcher will have clearer biofeedback of proper pitching mechanics. Also, as muscle memory improves, the pitcher will naturally assume the proper mechanics during the course of a game. As such, it is important that, during practice, the pitcher pitch with proper mechanics throughout practice. As a result, it is desired that the proper mechanics achieved during practice will translate to proper mechanics during the course of a game.

In the past, various patents have issued relating to devices for improving proper pitching techniques. For example, U.S. Patent Publication No. 2004/0077436, published on Apr. 22, 2004 to Goucher et al., describes a device for training an athlete to throw a ball. The device includes a base with a tubing extending upwardly from the base. The tubing is telescopic so as to allow for height adjustment. A pair of transverse guide members extend outwardly of the tubing. One of the guide members is an elbow guide. The other guide member is a ball guide. The ball guide and the elbow guide extend in spaced relationship to each other. In use, the pitcher will place his or her elbow on the elbow pad and then hold the ball so that the ball is in the ball guide.

U.S. Patent Publication No. 2004/0132557, published on Jul. 8, 2004 to Broglio et al., describes another training device for throwing. The training device includes parallel planar guides in a position behind a user relative to a throwing target. The throwing target is in the plane of the planar portion of the guides. When the user moves his or her hand in a throwing motion, the planar guides provide tactile feedback to the user indicating when the user is breaking a desired planar throwing motion. With repetition of the throwing motion by using the device, the pitcher can develop muscle memory of the proper throwing form.

U.S. Patent Publication No. 2004/0033849, published on Feb. 19, 2004 to R. D. Socci, describes a consistent release training device for pitcher. The device includes an elongated member which is adjustable in length. A sensory device is secured to the elongated member. The sensory device emits energy so as to define a space which can be sensed by the hand of pitcher.

U.S. Pat. No. 5,704,855, issued on Jan. 6, 1998 to J. V. Kellogg, Jr., describes a baseball pitching practice apparatus. This pitching apparatus utilizes a singular one-piece supporting base with centrally located apertures for holding two spaced apart vertical parallel uprights affixed with two horizontal parallel cross members for framing a strike zone in space. The strike zone is adjustable in height and adjustable in width.

U.S. Pat. No. 6,899,646, issued on May 31, 2005 to S. G. Conradi, describes a "pitching mate" system for baseball pitcher training. The system includes a target with a top surface at rest in a horizontal position and a momentary deflection position. The momentary deflection position will be occurring in response to receiving the strike of a towel. A support is included with a base for interfacing with the ground. The support includes a height adjustment mechanism. The pitcher uses a hand towel folded in half and throws the hand towel toward the target in order to improve pitching technique.

It is an object of the present invention to provide a device that enhances pitching fundamentals so that pitchers and coaches can easily learn and understand the basics of pitching.

It is another object of the present invention to provide a device that forces the player into proper fundamentals.

It is another object of the present invention to provide a device that leads to the throwing of consistent strikes and leads to proper ball control.

It is another object of the present invention to provide a device for enhancing pitching fundamentals which is easy to use and easy to assemble.

It is a further object of the present invention to provide a device for enhancing pitching fundamentals which is relatively inexpensive.

These and other objects and advantages of the present invention will become apparent from a reading of the attached specification and appended claims.

BRIEF SUMMARY OF THE INVENTION

The present invention is an apparatus for improving pitching mechanics of a pitcher that comprises a base, a member extending upwardly from the base, a boom extending outwardly from the member, and a first indicator means affixed to the boom for corresponding in relative location to a position where the pitcher's lead foot or lead shoulder should be positioned. A second indicator can be connected to the boom for corresponding in location to where the desired release point of the pitch by the pitcher should be.

In the present invention, the member is adjustably positioned in height relative to the base. In particular, the member is slidably positioned in a slot of the base. A position fixing means is connected to one of the member and the base for fixing the height of the member relative to the base. The member is in rotatable relationship to the base. In particular, the member is a tubular vertical member. The boom is connected to the tubular vertical member and extends horizontal outwardly therefrom. A first elbow is affixed to an upper end of the tubular vertical member. The boom has an end received within this elbow.

In the present invention, the first indicator means has a first annular member affixed around the boom. This first annular member is selectively slidable on the boom. The second indicator means includes a second annular means affixed around the boom in spaced parallel relationship to the first annular member.

In an alternative form of the present invention, a foot indicator means is adjustably connected to the base and extends outwardly from a lower end thereof. This foot indicator means corresponds in location to a desired position of a lead foot of the pitcher. The base has a channel extending outwardly from a lower end thereof. The foot indicator means has a rod adjustably and rotatably received in this channel. The foot indicator means is a foot-shaped member pivotally affixed to an end of the rod opposite the base.

The apparatus of the present invention can also be used for softball training. In such a configuration, an auxiliary boom is connected to an end of the boom opposite the member. The second indicator means is connected to the auxiliary boom and corresponds in relative location to the desired release point of the softball from a pitch by the softball pitcher. The auxiliary boom is a tubular member extending vertically while the boom extends horizontally. An elbow is affixed to an end of the boom opposite the member. The auxiliary boom has an end affixed to the elbow. In particular, the boom includes a first boom section extending horizontally from the end of the member opposite the base, a second boom section extending vertically downwardly from an end of the first boom section opposite the member, and a third boom section extending horizontally from an end of the second boom section opposite the first boom section. The first indicator means is positioned on the third boom section. The auxiliary boom extends vertically upwardly from an end of the third boom section opposite the second boom section.

The base can include a slot formed therein below the member. The member is receivable in the slot so as to extend horizontally outwardly of the slot. An adapter is adjustably mounted over at least one of the base and the member. In an alternative form of the present invention, a batting tee can be affixed to an end of the boom opposite the base. This batting tee has a ball receiving receptacle formed at an end thereof opposite the boom.

DETAILED DESCRIPTION OF THE INVENTION

Figure 1:
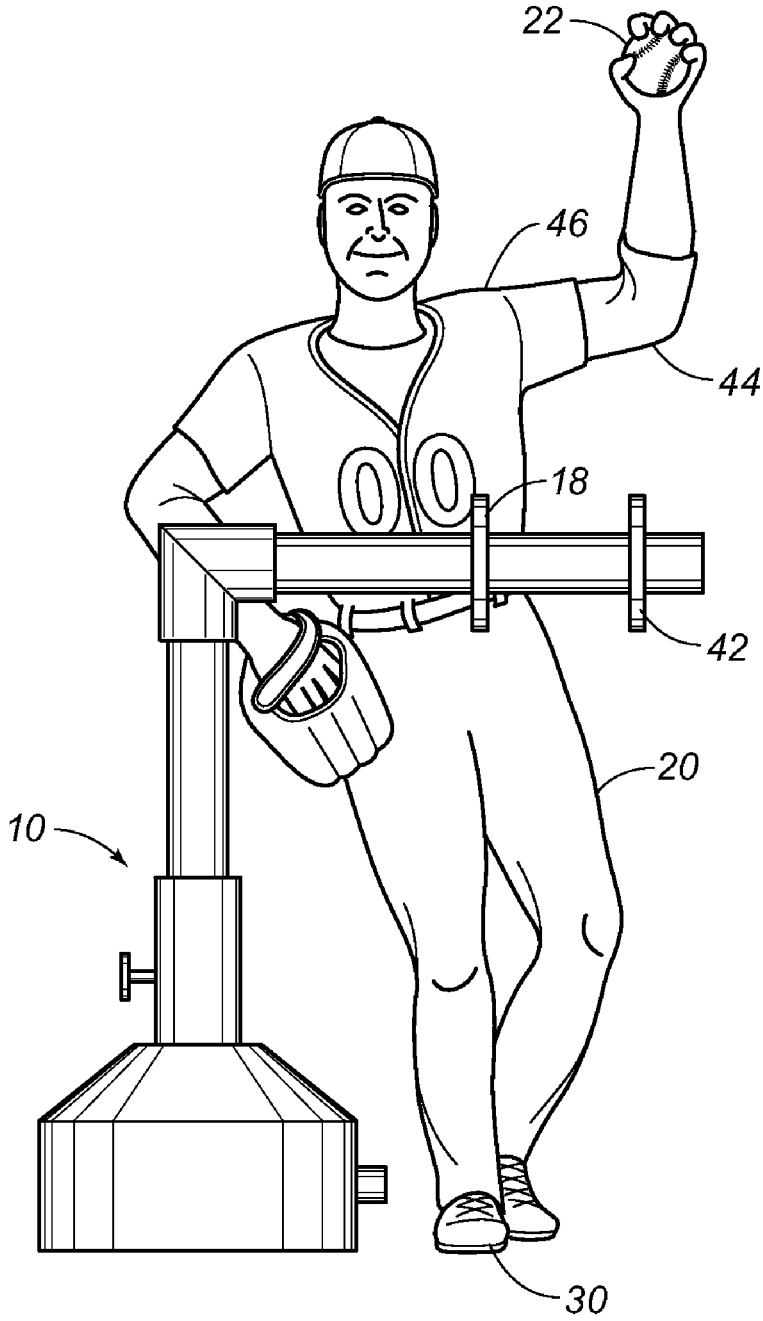
FIG. 1 is a diagrammatic illustration showing the use of the apparatus of the present invention during the course of a pitching activity.

Referring to FIG. 1, there is shown the apparatus 10 in accordance with the teachings of the present invention, during the pitching activity. As can be seen, the pitcher 20 has his or her elbow 44 positioned in alignment with a second indicator 42. The release point of the ball 22 is directly above the second indicator 42. The shoulder 46 of the pitcher 20 is aligned with the first indicator 18. Similarly, the lead foot 30 of the pitcher 20 is also aligned with the first indicator 18. In this manner, the pitcher is able to carry out proper mechanics during the pitching activity.

Figure 2:
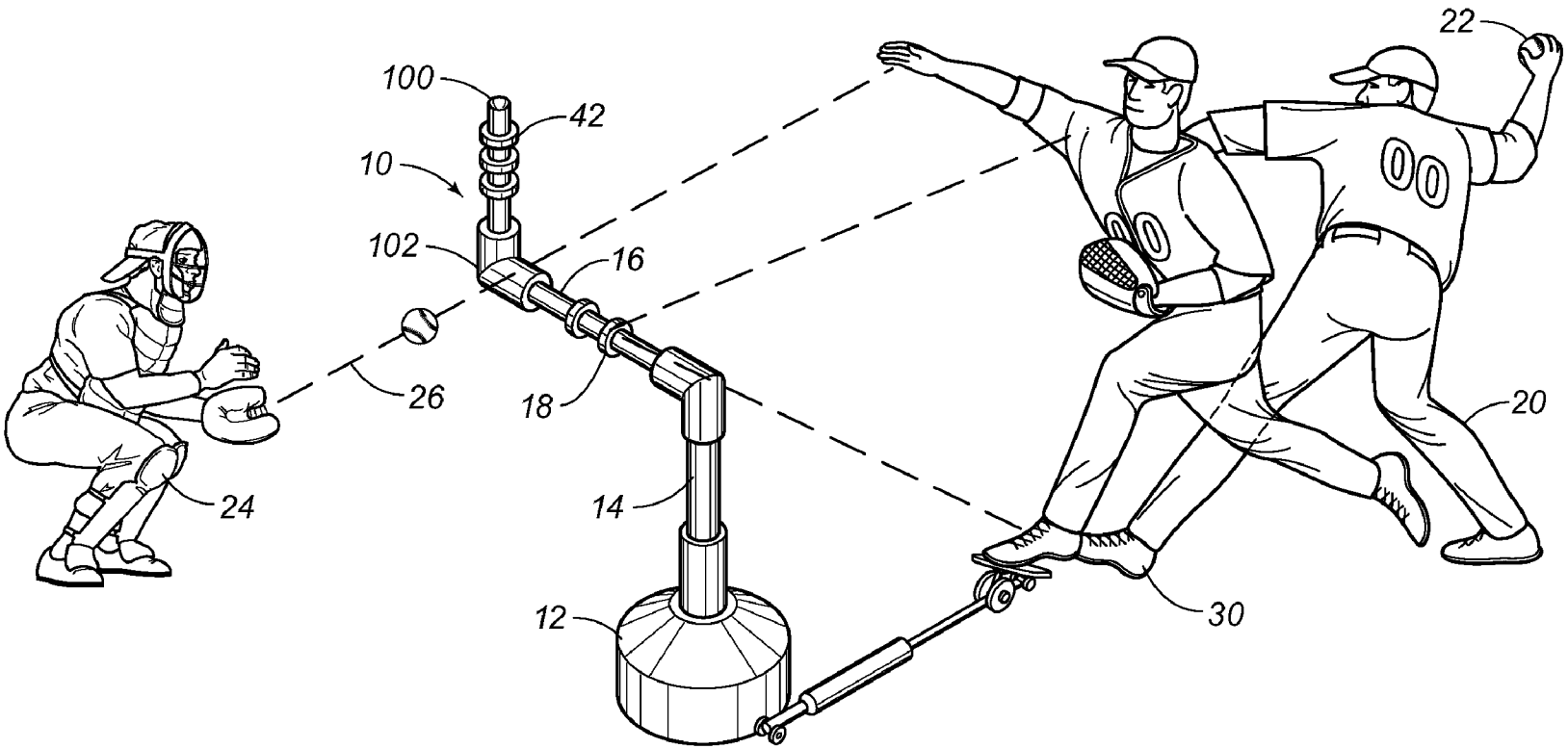
FIG. 2 is a partially cross sectional view showing the apparatus of the present invention.

FIG. 2 also shows the apparatus 10, which includes a base 12 with a member 14 extending vertically upwardly therefrom. A boom 16 extends horizontally outwardly from the end of the member 14 opposite the base. A first indicator 18 is positioned on the boom 16 in a desired location. In FIG. 2, it can be seen that there is a pitcher 20 that is throwing a ball 22 in a direction toward a catcher 24. The path of the ball 22 is indicated by broken line 26.

The apparatus 10 of the present invention breaks down the pitching fundamentals so that players and coaches can easily learn and understand the basics. The pitcher 20 is forced into proper fundamentals by placing the apparatus 10 in front of the pitcher 20 and then throwing the ball 22 over the boom 16 toward the catcher 24. The indicators 18 serve as visual reference points so as to lead the pitcher 20 to throwing consistent strikes and for achieving ball control.

The apparatus 10 of the present invention forces the basic fundamentals of pitching when throwing the ball 22 over the boom 16 toward the catcher 24. It forces the pitcher 20 to keep weight back on the pivot foot so as to allow the elbow of the throwing arm to elevate the player's shoulder and force the pitcher 20 to throw the ball 22 on a downward plane. This eliminates rushing. The body of the pitcher 20 moves forward before the elbow has time to elevate above the shoulder. Any rushing will cause the ball 22 to stay up in the strike zone. This can lead to erratic release points. The apparatus 10 keeps the motion of the pitcher 20 consistent on every pitch so as to allow the pitcher 20 to move the baseball 22 up and down, and left and right because the pitcher's lead foot will serve to give direction to each pitch. One of the indicators 18 on the boom 16 gives the pitcher 20 a reference point for the lead foot and the lead shoulder direction. The pitcher 20 strides toward the indicator 18 so as to keep the lead shoulder closed and release the ball 22 just above the second indicator. This results in consistent pitches and pinpoint accuracy. When the pitcher 20 finds the proper stride, release point and follow through in order to place the ball 22 in the middle of the strike zone consistently, the pitcher 20 can then move the ball in and out of the strike zone by mere placement of the lead foot 30. Striding a longer distance toward the catcher 24 will cause the ball 22 to be lower. A shorter stride will cause the ball 22 to be higher. Any strides left or right will cause the ball 22 to move left and right.

FIG. 2 also shows the auxiliary boom 100 connected to an end of the boom 16 opposite the member 14. The second indicator 42 connects to the auxiliary boom 100, corresponding in location to a desired release point of a pitch by the pitcher. The auxiliary boom 100 is a tubular member extending vertically, while the boom 16 extends horizontally. An elbow 102 is affixed to the end of the boom 16 opposite the member 14, and the auxiliary boom 100 attaches to the other end of the elbow. The present invention teaches pitching mechanics for an overhand motion for both left-handed and right-handed pitchers. The auxiliary boom 100 allows the apparatus to teach three-quarter (¾) motion pitching mechanics. Furthermore, the auxiliary boom 100 can help teach a curve-ball by an overhand motion. The vertical dimension of the second indicator 42 sets a release point that can be used to teach both overhand motion pitching and three-quarter motion pitching by both baseball and softball pitchers.

Figure 3:
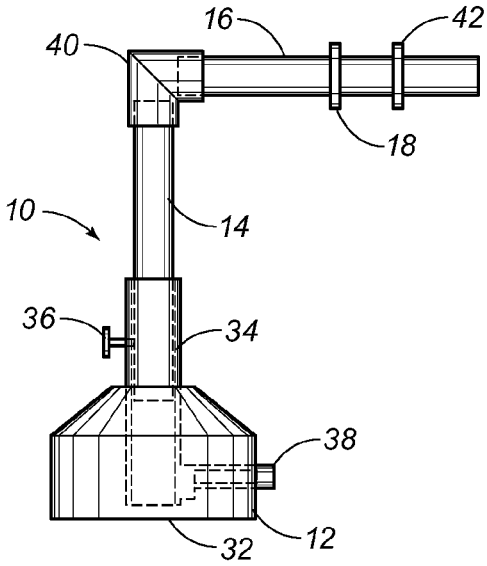
FIG. 3 is an end view showing the base of the apparatus of the present invention.

FIG. 3 is a detailed view of the apparatus 10 of the present invention. As can be seen, the apparatus 10 includes a base 12 having a relatively wide bottom 32. A tubular portion 34 extends upwardly from an upper end of the base 12. This tubular extension 34 will receive the member 14 slidably therein. A position fixing element 36 is connected to the tubular extension 34 so as to fix a height of the member 14 relative to the base 12. The height adjustment allows for use by pitchers of all ages and heights. In particular, the position fixing element 36 can be in the form of a set screw, a nut, a clamp, or other related device. The member 14 is a tubular member that is slidably received within the tubular extension 34.

In FIG. 3, it can be seen that there is a tubular slotted member 38 extending outwardly from the base 12 generally adjacent to the bottom 32 of base 12. This tubular slot 34 is suitable for receipt of a boom therein so as to cause the boom to be in a proper position for coordinating with softball pitching activities.

An elbow 40 is affixed to an end of the member 14 opposite to the base 12. Elbow 40 is a 90° elbow. The boom 16 is slidably received within the elbow 40 so as to achieve a horizontal orientation. The first indicator 18 is an annular member that is affixed around the tubular boom 16 in a desired position corresponding in location relative to a position in which the player's lead foot or lead shoulder should be positioned. A second indicator 42 is also an annular member that is affixed around the outer diameter of the tubular boom 16. The second indicator 42 corresponds relative in location to where the desired release point of the pitch should be. The boom 16 has an end opposite the elbow 40 and opposite the member 14.

Figure 4:
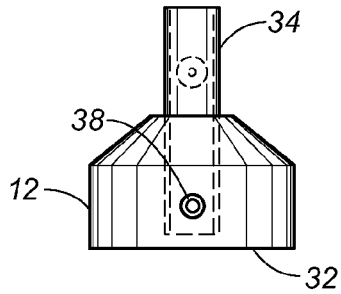
FIG. 4 is a frontal view showing the use of the apparatus of the present invention during pitching activity.

FIG. 4 shows an isolated view of the base 12. It can be seen that the base 12 has a tubular extension 34 extending upwardly therefrom. Tubular extension 34 should have a diameter suitable for accommodating the outer diameter of the member 14 therein. Tubular slot 38 is illustrated as extending outwardly of a side of the base 12 generally adjacent to the bottom 32 of the base 12.

Figure 5:
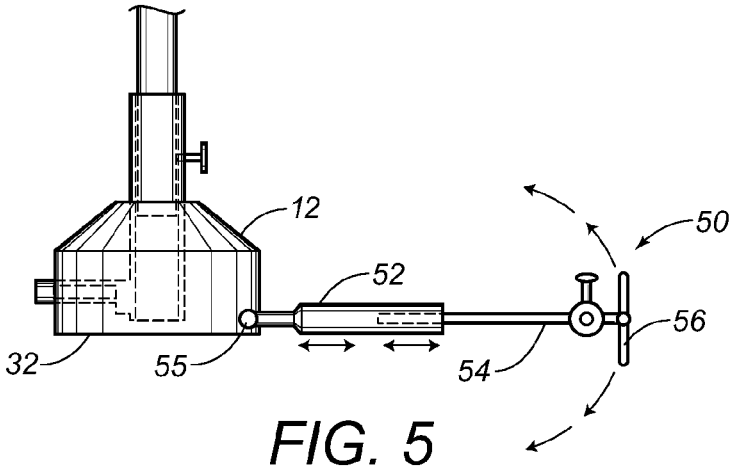
FIG. 5 is a side elevational view showing the foot indicator as coupled to the base of the apparatus of the present invention.

FIG. 5 illustrates the use of a foot indicator 50 in conjunction with the base 12 of the device of the present invention. As can be seen, the base 12 has a channel 52 extending outwardly therefrom generally adjacent to the bottom 32 thereof. The channel 52 has an end 55 pivotally connected to the base 12. A rod 54 is slidably and rotatably received within the channel 52 so as to allow the rod 54 to move inwardly or outwardly depending on the desired placement of the lead foot 30 of the pitcher 20. A foot-shaped indicator 56 is pivotally connected to an end of the rod 54 opposite the channel 52. This pivotal movement of the foot-shaped member 56 can be adapted so as to allow the pitcher 20 to assume a proper angular orientation of the lead foot 30 during the pitching activity.

Figure 6:
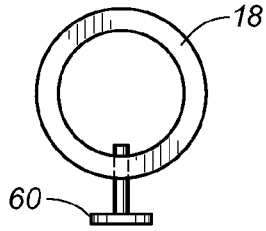
FIG. 6 is an isolated view of one of the indicators as used on the boom of the apparatus of the present invention.

FIG. 6 is an isolated view of indicator 18. It can be seen that the indicator 18 is an annular member. The indicator 18 can be of a different color than that of the boom 16 so as to enhance the visual identification of the indicator 18. A fixing device 60 is received by the indicator 18. Fixing device 60 is in the form of a set screw, a bolt, a fastener or a clasp which can assure the maintenance of a proper position of the indicator 18 along the surface of the boom 16. A release of the fixing element 60 can allow the indicator 18 to slide to another desired location along the boom 16.

Figure 7:
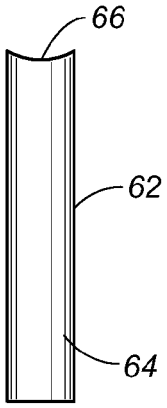
FIG. 7 is an isolated view of a pitching tee that can be optionally used as part of the apparatus of the present invention.

FIG. 7 is an isolated view of a pitching tee 62 that can be used in conjunction with the device 10 of the present invention (as will be described hereinafter). The pitching tee 62 includes a tubular body 64 that has a ball receiving end 66 at an upper end thereof.

Figure 8:
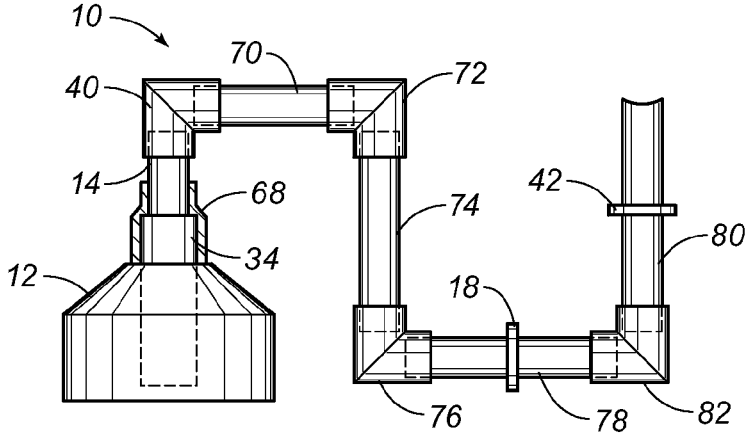
FIG. 8 is a side elevational view showing the apparatus of the present invention as adapted for softball pitching.

FIG. 8 shows an alternative embodiment of the present invention in which the apparatus 10 is adapted for use in conjunction with softball pitching activities. As can be seen, there is the base 12 with a member 14 extending upwardly therefrom and received within the tubular extension 34 of base 12. An adapter 68 is positioned over the tubular extension 34 and is cooperative with the member 14 so as to fix the position of the member 14. Adapter 68 can be in the nature of a collar. The adapter 68 can also include a tubular extension extending from a side thereof and adaptable to receive one of the booms associated with the present invention.

In FIG. 8, the elbow 40 is affixed to the end of the member 14 opposite the base 12. A first boom section 70 is received within the elbow 40 and extends in transverse relationship to the member 14. Another elbow 72 is connected to an end of the first boom section 70 opposite the elbow 40 and opposite the member 14. A second boom section 74 is received by the elbow 72 and extends vertically downwardly in transverse relationship to the first boom section 70. Another elbow 76 is connected to an end of the second boom section 74 opposite the elbow 72. A third boom section 78 has an end received within elbow 76 and extends outwardly horizontally therefrom at an end of the second boom section 74 opposite the first boom section 70. The first indicator 18 is positioned over this third boom section. A fourth boom section 80 is received by an elbow 82 affixed over an end of the third boom section 78 from the opposite to the elbow 76. The second indicator 42 is positioned over this fourth boom section 80. The fourth boom section 80 extends vertically upwardly in transverse relationship to the third boom section 78. The boom sections must be lowered to account for the underhand release points of a softball.

Figure 9:
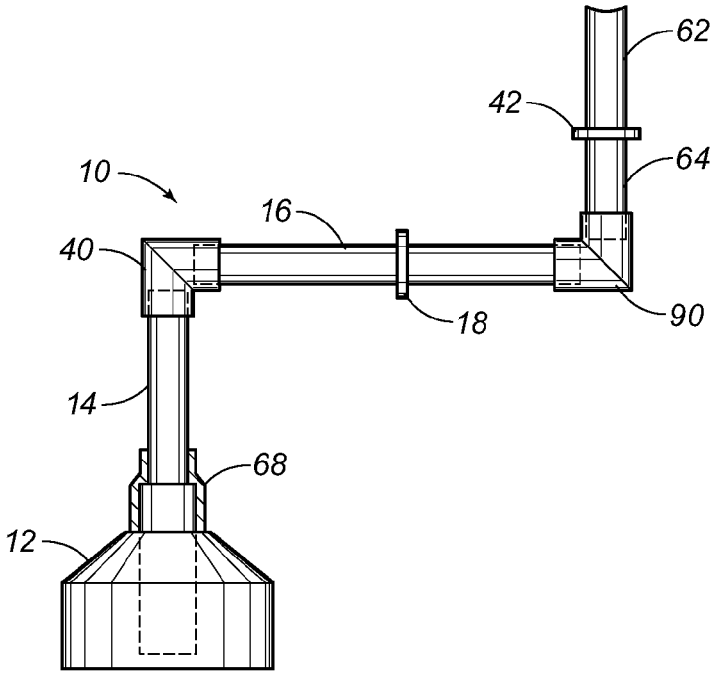
FIG. 9 is a side elevational view showing the present invention when adapted from a batting tee.
Figure 2:
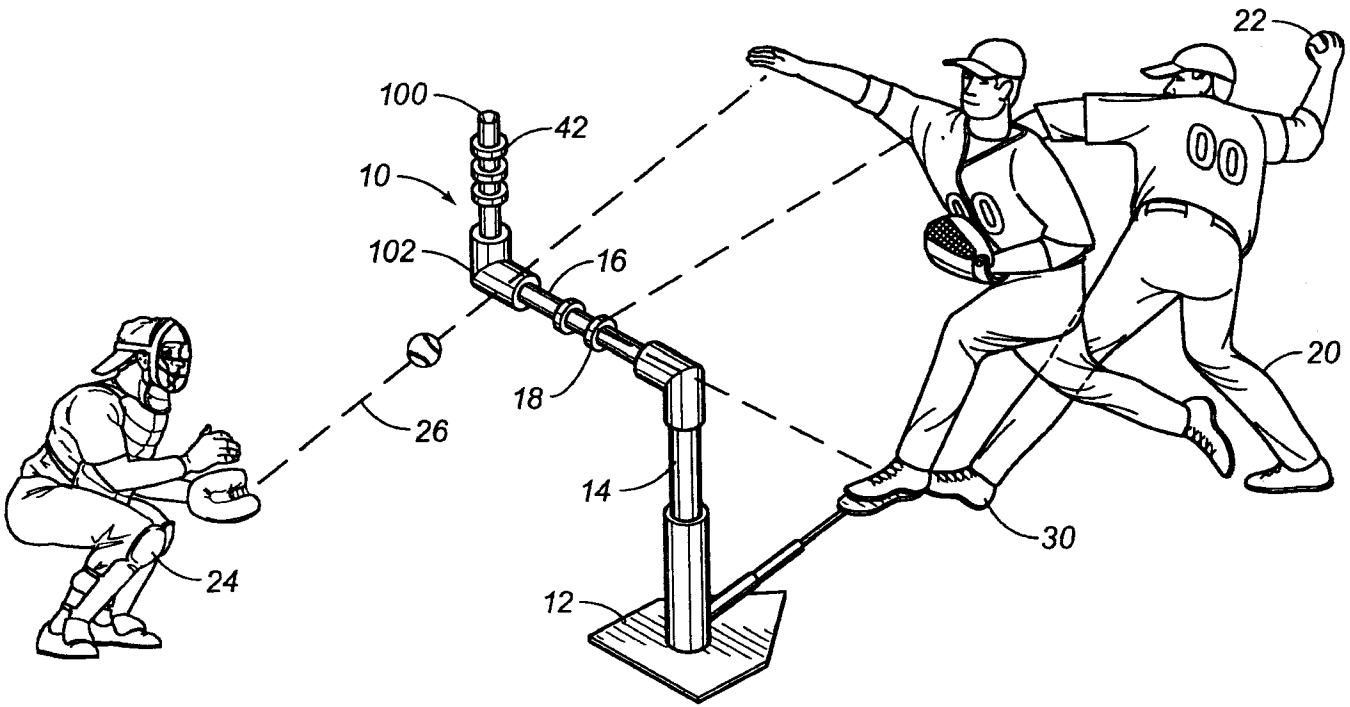
Figure 3:
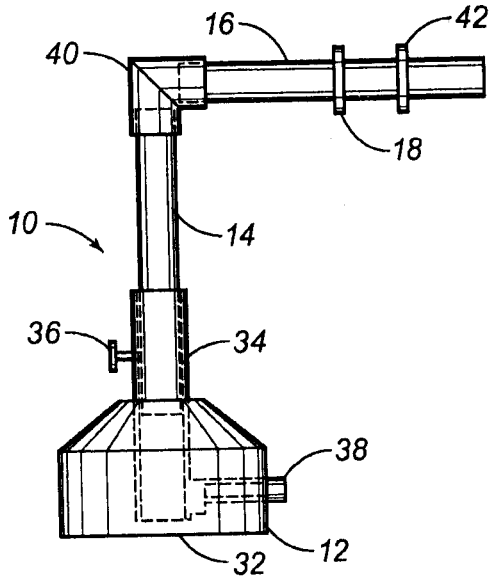
Figure 4:
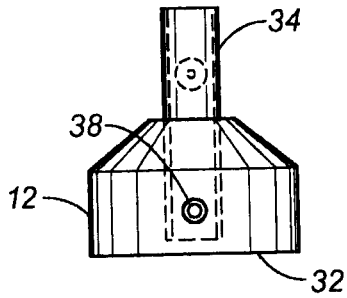
Figure 5:
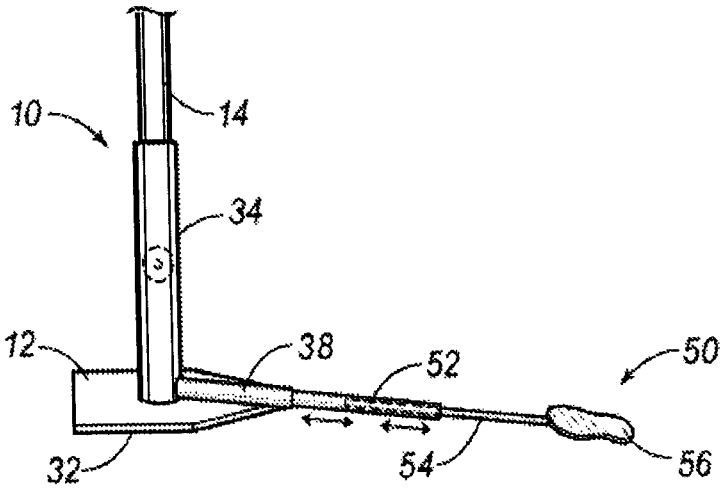
Figure 6:
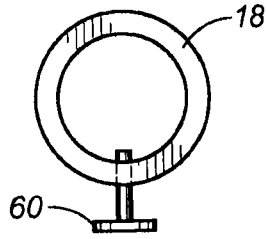

FIG. 9 is an alternative embodiment of the apparatus 10 of the present invention wherein the apparatus 10 is adapted for use in association with the batting tee 62. As can be seen in FIG. 9, the member 14 extends vertically upwardly from the base 12. The adapter 68 converts the batting tee into an apparatus of the present invention. The boom 16 is received in elbow 40 so as to extend in horizontal transverse relationship to the member 14. An elbow 90 is affixed to the end of the boom 16 opposite the elbow 40. The pitching tee 62 is received within the elbow 90 and extends vertically upwardly therefrom. In this arrangement, a ball can be received within the ball-receiving receptacle 66 formed at an end of the pitching tee 62 opposite to the elbow 90. The first indicator 18 is attached to the boom 16, and the second indicator 42 is positioned on the tubular body 64. The batting tee 62 converts the ball-receiving receptacle 66 thereof into an auxiliary boom so that the present invention can be adapted for use with an existing batting tee 62.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. An apparatus for teaching improved pitching mechanics to a pitcher, said apparatus comprising:

a base;

a member extending upwardly from said base, said member being adjustably positioned in height relative to said base and slidably positioned in a slot of said base, said member being rotatable in said base;

a position fixing means connected to one of said member and said base for fixing the height of said member relative to said base;

a boom extending outwardly from said member, said member being vertical, said boom connected to and extended horizontally from said member;

a first indicator means affixed to said boom for corresponding in location relative to a position where the pitcher's lead foot or lead shoulder should be positioned, said first indicator means being an annular member affixed around said boom, said first annular member being selectively slidable on said boom;

a second indicator means connected to said boom for corresponding in location to desired release point of a pitch by the pitcher, said second indicator means being a second annular means affixed around said boom in spaced parallel relation to said first annular member;

a foot indication means adjustably connected to said base and extending outwardly from a lower end thereof, said foot indicator means corresponding in location to a desired position of a lead foot of said pitcher relative to the first indicator means and second indicator means;

an auxiliary boom connected to an end of said boom opposite said member and extended vertically upward from said boom;

a third indicator means connected to said auxiliary boom for corresponding in relative location to desired release point adjustment of a curve ball pitch by the pitcher.

2. The apparatus of claim 1, further comprising:

a first elbow affixed to an upper end of said member, said boom having an end received in said elbow, said boom being a tubular horizontal member.

3. The apparatus of claim 1, said base having a channel extending outwardly from a lower end thereof, said foot indicator means having a rod adjustably and rotatably received in said channel, said foot indicator means having a foot-shaped member pivotally affixed to an end of said rod opposite said base.

4. The apparatus of claim 1, further comprising:

an auxiliary elbow affixed to said end of said boom opposite said member, said auxiliary boom having an end affixed to said auxiliary elbow.

5. The apparatus of claim 1, said base having a slot formed therein below said member, said member being receivable in said slot so as to extend vertically outwardly of said slot.

6. The apparatus of claim 1, further comprising:

an adapter adjustably mounted over at least one of said base and said member.

7. The apparatus of claim 1, wherein said base is comprised of a batting tee base, said member being a batting tee support extending vertically from said batting tee base, said member being affixed to an end of said boom by a ball-receiving receptacle formed at an end of batting tee support.

* * * * *

UNITED STATES PATENT AND TRADEMARK OFFICE

CERTIFICATE OF CORRECTION

PATENT NO. : 7,601,081 B1
APPLICATION NO. : 11/741569
DATED : October 13, 2009
INVENTOR(S) : Roger Elwin Larkey It is certified that error appears in the above-identified patent and that said Letters Patent is hereby corrected as shown below:

Cover Page, Item (75) Inventor should read
--Roger Elwin Larkey, Houston, TX (US)--.

Signed and Sealed this

Fifth Day of January, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,601,081 B1
APPLICATION NO. : 11/741569
DATED : October 13, 2009
INVENTOR(S) : Roger Elwin Larkey It is certified that error appears in the above-identified patent and that said Letters Patent is hereby corrected as shown below:

Title page, illustrative fig. 2 should be deleted and substitute therefore the attached title page consisting of the attached illustrative fig. 2.

In the Drawings

The drawing sheets 2 and 3 of 4 consisting of Fig(s) 2-6 should be deleted and substitute therefore the attached drawing sheets 2 and 3 of 4 consisting of Fig(s) 2-6.

Page 6, col. 4, II. 8-28
Please substitute the following revised description of drawings:

FIGURE 1 is a schematic view, showing use of the apparatus of the present invention during the course of a pitching activity.
FIGURE 2 is an upper perspective view showing the apparatus of the present invention in use.
FIGURE 3 is a front elevational view showing the use of the apparatus of the present invention during pitching activity.
FIGURE 4 is front elevational view showing a possible base of the apparatus of the present invention.
FIGURE 5 is a side perspective view showing the foot indicator as coupled to the base of the apparatus of the present invention.
FIGURE 6 is an isolated top plan view of one of the indicators as used on the boom of the apparatus of the present invention.
FIGURE 7 is an isolated elevational view of a pitching tee tube that can be optionally used as part of the apparatus of the present invention.
FIGURE 8 is a side elevational view, showing the apparatus of the present invention as adapted for softball pitching.
FIGURE 9 is a side elevational view, showing the present invention when adapted from a batting tee.

Signed and Sealed this

Second Day of March, 2010

David J. Kappos

David J. Kappos
*Director of the United States Patent and Trademark Office*